US007850294B2

(12) United States Patent
Yano

(10) Patent No.: US 7,850,294 B2
(45) Date of Patent: Dec. 14, 2010

(54) ACCOMMODATION DEVICE FOR INK CARTRIDGE

(75) Inventor: Hiroyasu Yano, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 894 days.

(21) Appl. No.: 11/693,199

(22) Filed: Mar. 29, 2007

(65) Prior Publication Data

US 2007/0165084 A1 Jul. 19, 2007

(30) Foreign Application Priority Data

Mar. 31, 2006 (JP) ..... 2006-100500

(51) Int. Cl.
*B41J 2/175* (2006.01)

(52) U.S. Cl. ..... 347/86

(58) Field of Classification Search ..... 347/85
See application file for complete search history.

(56) References Cited

U.S. PATENT DOCUMENTS

| | | | | |
|---|---|---|---|---|
| 5,221,935 | A | 6/1993 | Uzita | |
| 6,328,414 | B1 | 12/2001 | Yoshino | |
| 6,582,068 | B2 * | 6/2003 | Ishizawa et al. | 347/85 |
| 6,815,381 | B1 * | 11/2004 | Yamamoto et al. | 442/187 |
| 6,827,417 | B2 | 12/2004 | Seino | |

FOREIGN PATENT DOCUMENTS

| | | |
|---|---|---|
| JP | H05-004349 A | 1/1993 |
| JP | H09-240013 A | 9/1997 |
| JP | H11-198392 A | 7/1999 |
| JP | 20020079690 | 3/2002 |
| JP | 2005-125557 A | 5/2005 |

OTHER PUBLICATIONS

Japan Patent Office; Notification of Reason for Refusal in Japanese Patent Application No. 2006-100500 (counterpart to the above-captioned U.S. patent application) mailed Jan. 20, 2010.

* cited by examiner

*Primary Examiner*—Stephen D Meier
*Assistant Examiner*—Alexander C Witkowski
(74) *Attorney, Agent, or Firm*—Baker Botts L.L.P.

(57) ABSTRACT

An ink-cartridge accommodation device including: a case which has a front opening and which accommodates an ink cartridge storing ink so as to permit the ink cartridge to be inserted into and withdrawn from the case through the front opening; and a connector which is disposed in a rear portion of the case so as to be opposed to the front opening, which is to be connected to an ink supply portion of the ink cartridge, and which includes (a) an ink introducing pipe portion projecting toward the front opening, (b) a guide rib portion provided around the ink introducing pipe portion so as to project toward the front opening for guiding the ink supply portion, and (c) a drain hole provided between the ink introducing pipe portion and the guide rib portion to drain the ink.

17 Claims, 11 Drawing Sheets

ACCOMMODATION DEVICE FOR INK CARTRIDGE

The present application is based on Japanese Patent Application No. 2006-100500 filed on Mar. 31, 2006, the contents of which are incorporated herein by reference.

BACKGROUND OF THE INVENTION

1. Field of the Invention

The present invention relates to a structure of an accommodation device (a refill unit) for an ink cartridge mounted on an ink-jet recording apparatus (an ink-jet printer).

2. Description of the Related Art

In general, an ink-jet recording apparatus, such as a printer, records an image on a recording medium with ink which is ejected from a recording head. The recording head is mounted on a carriage which reciprocates in a direction (in a main scanning direction) perpendicular to a direction in which the recording medium is fed. Ink which is stored in advance in a cartridge-type ink tank (an ink cartridge) is supplied to the recording head from the ink cartridge.

There are generally two types of ink cartridges broadly distinguished by their location in the ink-jet recording apparatus: what is called, an on-carriage type and an off-carriage type. In the on-carriage type ink cartridge, ink is supplied to a recording head from an ink cartridge which is removably accommodated in a required case mounted on a reciprocable carriage. On the other hand, in the off-carriage type ink cartridge, an ink cartridge is accommodated in a required case mounted somewhere in a housing of an ink-jet recording apparatus except on a carriage. Ink is supplied to the recording head through an ink supply tube or the like from the case in which the cartridge is accommodated.

Generally, in any types of the ink cartridges, replacement of the ink cartridge to new one is required when an amount of ink remaining in the ink cartridge becomes small.

JP-2002-79690A discloses an example of an ink cartridge wherein an ink supply needle for leading ink into the recording head is fitted on a plug element which is provided in an area of an ink supply opening in the cartridge. This prevents ink from leaking between the needle and the plug element. To this end, the plug element is made of an elastic member, such as a rubber material, and includes a guide tube and a plug portion. The guide tube is formed so as to fit to a recess portion defined by a tubular member which is projected from an outer peripheral portion of the ink supply needle in the recording head. The plug portion is formed radially inside the guide tube for closely contact with the ink supply needle. Between the guide tube and the plug portion, a space is provided. The plug portion has a tubular portion for guiding the ink supply needle and a tapered portion for sealing an ink inlet.

However, the structure of the ink cartridge disclosed in JP-2002-79690A suffers from the following problem. With each removal of the ink cartridge, ink adhering to a peripheral surface of the ink supply needle flows to a basal portion thereof and accumulates in the recess portion. When a new ink cartridge is inserted, the accumulated ink transfers to an end surface or a peripheral surface of the guide tube of the ink cartridge. This causes the ink to stain a body of the ink-jet recording apparatus, a desk, or a garment of a user when the cartridge is inserted or removed, or in a state in which the cartridge has been removed.

SUMMARY OF THE INVENTION

It is an object of the present invention to provide an ink-cartridge accommodation device, with a simple structure, which prevents ink leaked to an ink introducing portion from transferring to an ink cartridge.

The object indicated above may be achieved according to an aspect of the present invention, which provides an ink-cartridge accommodation device comprising: a case which has a front opening and which accommodates an ink cartridge storing ink so as to permit the ink cartridge to be inserted into and withdrawn from the case through the front opening; and a connector which is disposed in a rear portion of the case so as to be opposed to the front opening, which is to be connected to an ink supply portion of the ink cartridge, and which includes (a) an ink introducing pipe portion projecting toward the front opening, (b) a guide rib portion provided around the ink introducing pipe portion so as to project toward the front opening for guiding the ink supply portion, and (c) a drain hole provided between the ink introducing pipe portion and the guide rib portion to drain the ink.

In the ink-cartridge accommodation device constructed according to the aspect described above, if the replacement of the ink cartridge is repeated, or the insertion and removal of the ink cartridge are repeated, waste ink tends to flow toward a proximal end of the ink introducing pipe portion from the outer periphery surface thereof and to accumulate around the proximal end thereof. However, owing to the drain hole located between an outer periphery of the ink introducing pipe portion and the inner periphery of the guide rib portions, the waste ink flows to a back surface of the connector via the drain hole. This reduces a frequency with which an ink supply portion of the ink cartridge is stained with ink.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DESCRIPTION OF THE PREFERRED EMBODIMENTS

Figure 1:
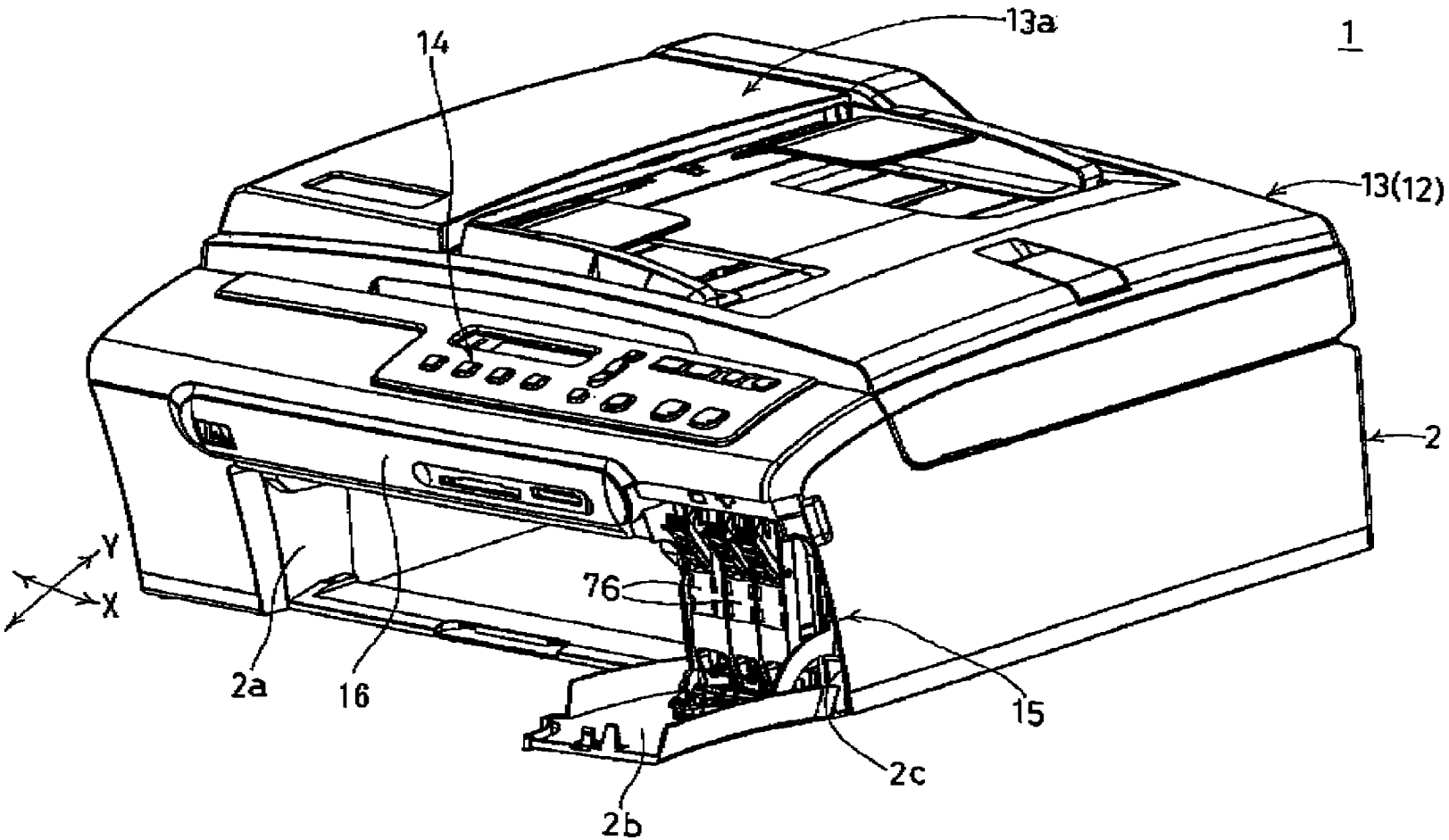
FIG. 1 is an external perspective view showing an image-recording apparatus according to an embodiment of the present invention.

Referring to the drawings, there will be described preferred embodiments of the present invention.

An image-recording apparatus 1 according to one embodiment of the present invention is a multi function device (MFD) which has a printing function, a copying function, a scanning function and a facsimile function and to which the present invention is applied. The multi function device is connected to a computer (not shown) and records an image or characters on a recording sheet (a recording medium) on the basis of image-data or document-data mainly sent from the computer. The multi function device may also be connected to an external device, such as a digital camera, and record an image on a recording sheet on the basis of image-data outputted from the device.

Figure 2:
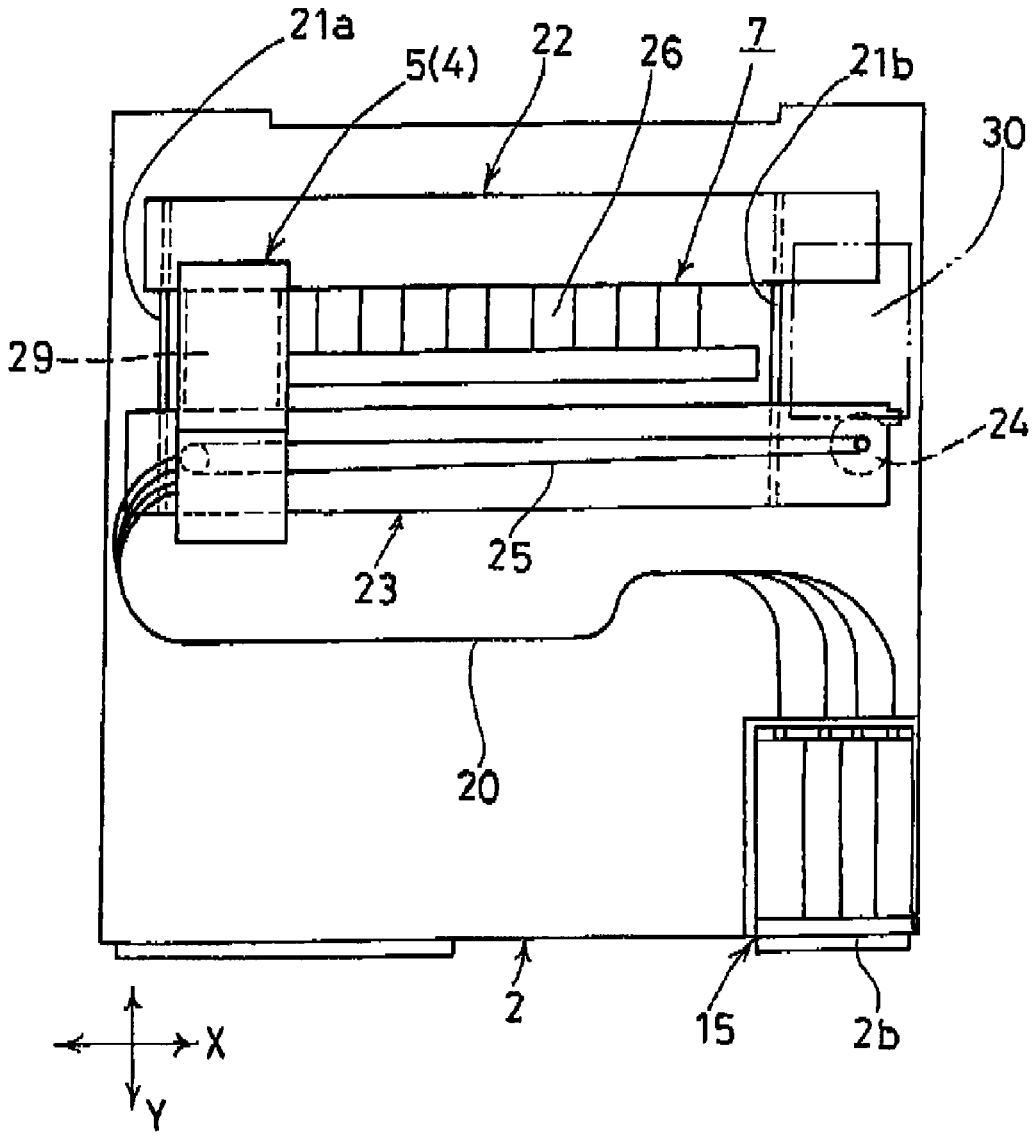
FIG. 2 is a plan view of a housing (a main casing) with its upper case removed.
Figure 3:
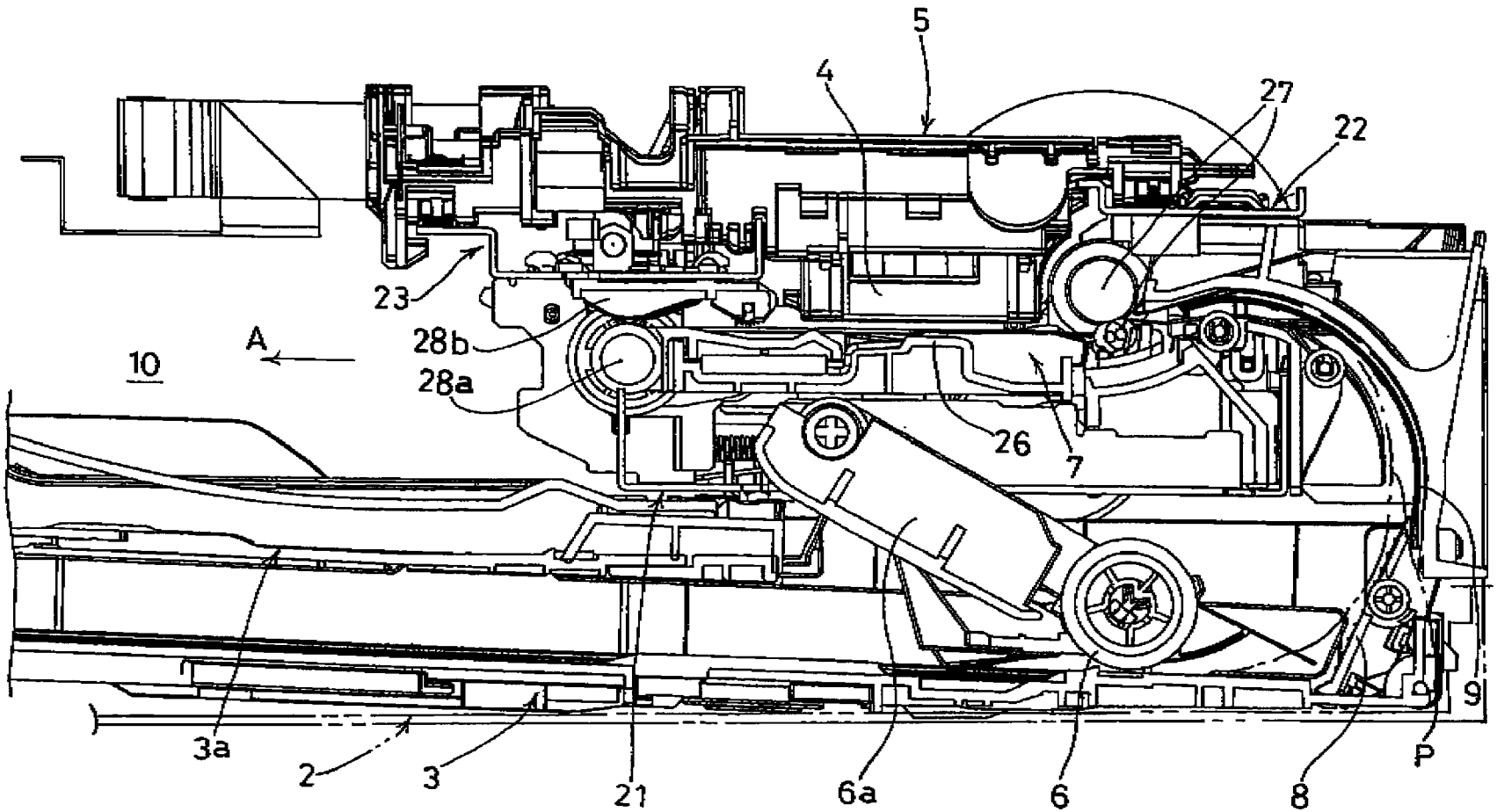
FIG. 3 is a cross-sectional view showing a main portion of a recording portion.

In the present embodiment, as shown in FIGS. 1-3, a recording portion (printing portion) 7 is provided in a lower portion of a casing 2 which is formed of synthetic resin. The casing 2 has an insertion opening 2*a* which is open in one side of the casing 2. A sheet supply cassette 3 is disposed in a cassette accommodating portion (an accommodating space) which is provided in a bottom portion of the casing 2 and is inserted and withdrawn through the insertion opening 2*a*, that is, the sheet supply cassette 3 is inserted and withdrawn in a substantially horizontal direction. In the following description, the side of the casing 2 in which the insertion opening 2*a* is open will be referred to as a "front side" or "front". In this connection, respective sides of the image recording apparatus 1 will be referred to as a "front side," a "right and left side," and a "back (rear) side." In a front portion of the casing 2, there is provided a slot portion 16 which is arranged to mount various types of storage media therein, such as a memory card. Images or the like may be recorded on the recording sheet on the basis of various data stored in a storage medium which is mounted in the slot portion 16.

On an upper portion of the casing 2, an image-reading device (a scanning portion) 12 is disposed for reading an original in the copying function or the facsimile function.

There is provided a control panel portion 14 which has various types of operation buttons, a liquid crystal display portion, and the like in front of the image-reading device 12 on the upper portion of the casing 2. There are disposed a recording portion 7, a sheet discharge portion 10, and so on within a projected area including the image-reading device 12 and the control panel portion 14 in plan view. An ink-cartridge accommodation device 15 which will be described in greater detail below is built in one side of the sheet discharge portion 10 (on the right side in FIG. 1) and in the front portion of the casing 2. A front surface of the ink-cartridge accommodation device 15 is covered by a cover 2*b* which is pivotably attached to the front portion of the casing 2 through a hinge at a lower end of the cover 2*b* so as to be opened and closed. Namely, the cover 2*b* pivots between a posture in which the ink-cartridge accommodation device 15 is exposed to a front opening 2*c* of the casing 2 by tilting forward the cover 2*b* as shown in FIG. 1 and a posture in which the ink-cartridge accommodation device 15 is covered with the cover 2*b* by closing the cover 2*b*.

On an upper surface of the image-reading device 12, there is provided a glass plate (not shown) on which an original is placed. Under the glass plate, there is provided an image scanner device (CIS: Contact Image Sensor, not shown) for reading an original. The image scanner device reciprocates in a direction perpendicular to a sheet surface of FIG. 3 (in a main scanning direction, hereinafter, referred to as an X-axis direction, and an axis extending in a main scanning direction referred to as an X axis).

The cover 13 covering the glass plate is provided with an automatic document feeder (ADF) 13*a* and is attached to the case 2 through a hinge at a rear end portion of the cover 13 (in a right back portion in FIG. 1) so as to be opened upward and closed downward.

In the present embodiment, as shown in FIG. 3, the sheet supply cassette 3 accommodates a stack of sheets P (recording media) of selected sizes, such as the A4 size, letter size, legal size or postcard size, such that a short side of the sheets P extends in a direction (in the main scanning direction, the X-axis direction) perpendicular to a sheet feeding direction (a sub scanning direction, hereinafter, referred to as a Y-axis direction).

On an upper portion of the sheet supply cassette 3, an auxiliary cassette 3*a* is mounted movably in the Y-axis direction. The auxiliary cassette 3*a* accommodates a stack of smaller-sized sheets which are to be supplied. In FIG. 1, the sheet supply cassette 3 and the auxiliary cassette 3*a* are not shown.

In a back portion of the sheet supply cassette 3 (the right side in FIG. 3), an inclined sheet separator plate 8 is disposed for separating each sheet P from the stack. An arm 6*a* is pivotably supported at an upper end thereof by the casing 2 such that the arm 6*a* is pivotable upward and downward. The separator plate 8 cooperates with a sheet supply roller 6 provided at a lower end of the arm 6*a* to separate and feed, one by one, the sheets P which are stacked in the sheet supply cassette 3 and the auxiliary sheet supply cassette 3*a*. The separated sheet P is supplied to the recording portion 7 disposed above and at a back of the sheet supply cassette 3, through a U-turn path (a supply path) 9 which extends an upward and sideways direction. The recording portion 7 includes a reciprocable carriage 5 on which an inkjet type recording head 4 is mounted for realizing the printing function.

On the auxiliary sheet supply cassette 3*a*, there is provided the sheet discharge portion 10 to which the sheet P printed in the recording portion 7 is ejected with its printed surface upward. The sheet discharge portion 10 communicates with a sheet discharge opening which is an upper portion of the insertion opening 2*a* and open to the front surface of the casing 2.

Figure 4:
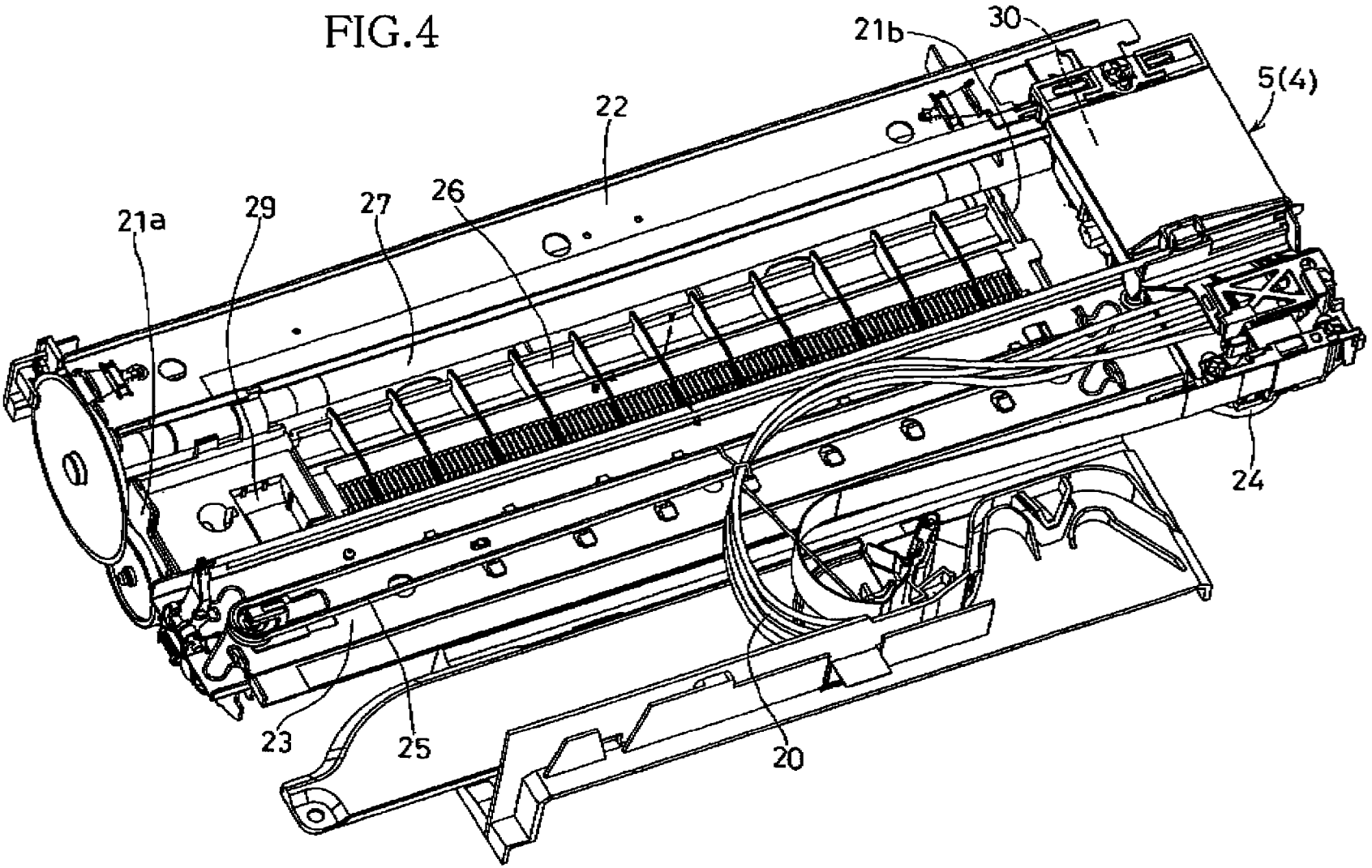
FIG. 4 is a perspective view of the recording portion.

As shown in FIGS. 2 and 4, the recording portion 7 includes: first and second guide members 22, 23, which are supported by a pair of right and left side plates 21*a*, 21*b* that constitute a main frame 21 opening upward and each of which has an elongate plate-like shape extending in the X-axis direction (in the main scanning direction); the reciprocable carriage 5 slidably supported by or mounted on the first and second guide members 22, 23 so as to bridge these two guide members 22, 23; a timing belt 25, serving as an endless belt, which is disposed on and parallel to an upper surface of the second guide member 23 so as to be wound around pulleys to reciprocate the carriage 5 on which the recording head 4 is mounted; a CR (carriage) motor 24 by which the timing belt 25 is driven (another motor, such as a stepping motor, may be used, while a DC motor is used in the present embodiment); a platen 26 which has a plate shape and supports the sheet P fed below a lower surface of the recording head 4; and a tape scale (not shown) which is a component of an optical linear encoder and arranged to extend in the main scanning direction for detecting a position and a moving speed of the carriage 5 in the X-axis direction (in the main scanning direction). The first guide member 22 is disposed upstream in the sheet feeding direction (in a direction of arrow A in FIG. 3) in which the sheet P is fed through on the platen 26 while the second guide member 23 is disposed downstream in the sheet feeding direction.

A pair of registering rollers 27 are disposed in an upstream portion of the platen 26 in the sheet feeding direction to feed the sheet P into a clearance between the platen 26 and a nozzle surface which is the lower surface of the recording head 4. In a downstream portion of the platen 26 in the sheet feeding direction, there are disposed a spur 28*b* which is contacted with an upper surface of the sheet P and a sheet discharge roller 28*a* which is driven on a lower surface of the sheet P, such that a recorded sheet P is fed to the sheet discharge portion 10.

The recording portion 7 includes opposite end portions which are located outside widthwise opposite sides of the sheet P which is to be fed (outside longitudinal sides of the sheet P). An ink receiver 29 is disposed on one of the opposite end portions of the recording portion 7 (on a portion near the side plate 21*a* or in the left side in FIGS. 2 and 4 in the present embodiment) and a maintenance unit 30 is disposed on the other opposite end portion of the recording portion 7 (on a portion near the side plate 21*b* or in the right side in FIGS. 2 and 4). During a recording operation, the recording head 4 ejects ink periodically, for preventing clogging or plugging of nozzles, at a flushing position in which the recording head is opposed to the ink receiver 29. The ink receiver 29 receives the ejected ink. The maintenance unit 30 executes a recovery process when the carriage 5 is positioned at a standby position. In the recovery process, inks in the recording head 4 are selectively sucked for each color and air bubbles in a buffer tank (not shown) on the recording head 4 are removed. The maintenance unit 30 has a wiper (not shown) which cleans the nozzle surface of the recording head 4 when the carriage 5 is moved toward the image-recording area away from the maintenance unit 30.

Next, a configuration of the ink-cartridge accommodation device 15 will be described. The ink-cartridge accommodation device 15 includes a case 74 which accommodates four ink cartridges 60 arranged in a straight row in the X-axis direction. The four ink cartridges 60 store inks of respective four colors for full-color recording, namely, black (BK), cyan (C), magenta (M), and yellow (Y), and each of the ink cartridges 60 has a rectangular box-like shape with a relatively small area in plan view and a relatively large height dimension. The case 74 is configured so as to permit the ink cartridges 60 to be inserted into and withdrawn from the case 74 through a front opening 74*a* thereof when doors 76 capable of opening and closing the front opening 74*a* are opened.

As shown in FIGS. 6B and 7A-7C, a connector 62 as a connecting means is disposed in a rear portion of the case 74 so as to be opposed to the front opening 74*a*. The connector 62 has an upper vertical plate portion 62*a* and a lower vertical plate portion 62*b* by which the connector 62 is made in a stepped shape. That is, with reference to FIG. 11, the lower vertical plate portion 62*b* is positioned more backward than the upper vertical plate portion 62*a* by a dimension L1.

In correspondence with the respective ink cartridges 60, four needle-like ink introducing pipe portions 63 are formed integrally with the upper and the lower vertical plate portions 62*a*, 62*b* so as to project to an interior of the case 74 from a boundary portion between the upper and the lower vertical plate portions 62*a*, 62*b*. Each of the ink introducing pipe portions 63 has a relatively small diameter in a distal end thereof and a relatively large diameter in a proximal end thereof. The inks stored in the ink cartridges 60 are supplied to the recording head 4 through respective four ink tubes 20 (as shown in FIGS. 2, 4, 6B and 11). Each of the ink tubes 20 is connected, at one end thereof, to a connecting portion 63*a* which is provided on a rear end portion of a corresponding one of the ink introducing pipe portions 63. For using ink colors more than four (e.g., from six colors to eight colors), the ink-cartridge accommodation device 15 may be configured to accommodate the ink cartridges 60 whose number is increased according to the number of the ink colors. The number of the ink tubes 20 may also be increased according to the number of the ink cartridges 60.

Figure 7A:
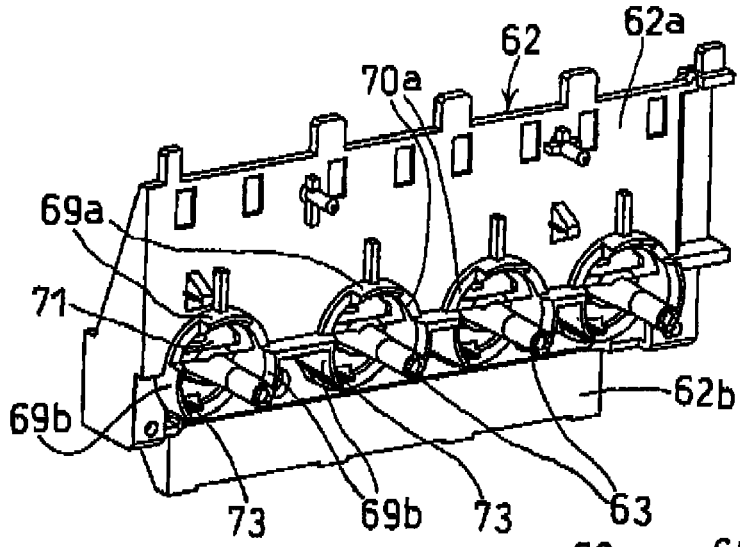
FIGS. 7A-7C are perspective views each showing a connector 62.
Figure 7B:
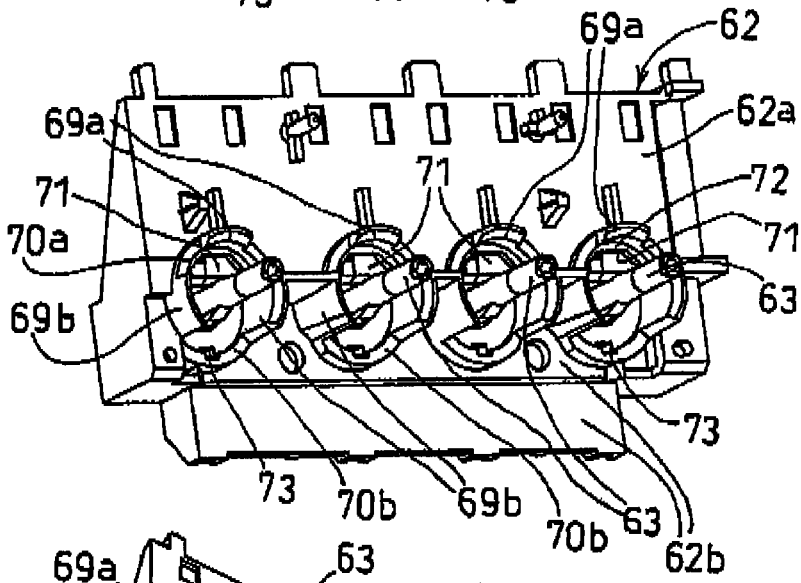
Figure 7C:
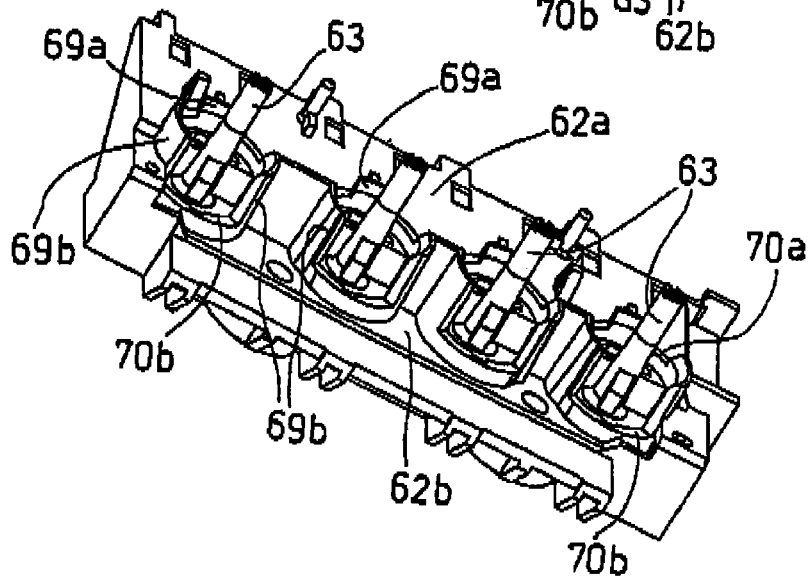

On a surface of the upper and the lower vertical plate portions 62*a*, 62*b*, which surface is astride the boundary portion between the upper and the lower vertical plate portions 62*a*, 62*b*, an upper guide rib portion 69*a* and right and left guide rib portions 69*b* are provided for each of the four ink introducing pipe portions 63. These guide rib portions 69*a*, 69*b* are formed circumferentially about an axis of each ink introducing pipe portion 63 so as to project from the surface. Each of the upper guide rib portion 69*a* and the right and left guide rib portions 69*b* has an arcuate shape in cross-section taken in a plane perpendicular to a direction in which the guide rib portions 69*a*, 69*b* project. As shown in FIGS. 7A-7C, there are formed two upper gaps 70*a*, one of which is formed between the upper guide rib portion 69*a* and the right guide rib portion 69*b* and the other of which is formed between the upper guide rib portion 69*a* and the left guide rib portion 69*b*. Further, a lower gap 70*b* is formed between the right and left guide rib portions 69*b*. Where it is regarded that the upper guide rib portion 69*a* is integral with the right and left guide rib portions 69*b*, it may be considered that one guide rib is formed.

Figure 11:
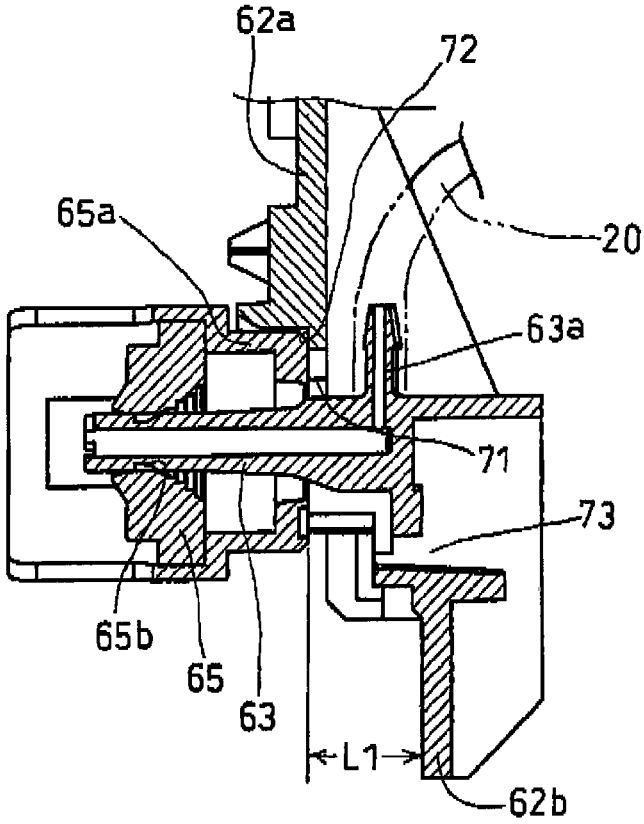
FIG. 11 is a fragmentary enlarged view in cross section showing a state in which a part of an ink supply portion is held in contact with a stopper surface 72 when the ink supply portion is connected to an ink introducing pipe portion.
Figure 12:
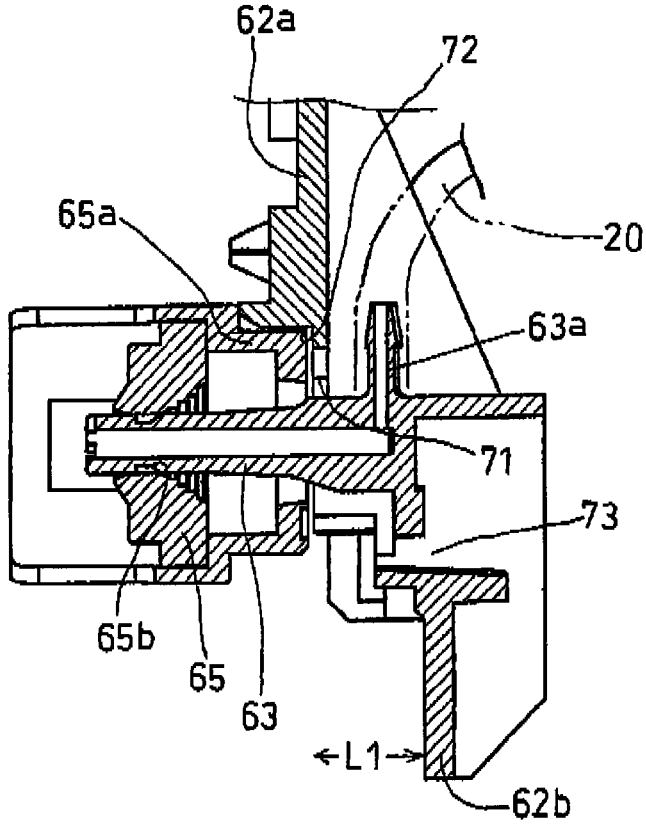
FIG. 12 is a fragmentary enlarged view in cross section showing a state in which a distal end of a guide rib portion is held in contact with a part of the ink cartridge when the ink supply portion is connected to an ink introducing pipe portion.

As shown in FIGS. 7A-7C, on the surface of the upper vertical plate portions 62*a*, for each of the four ink introducing pipe portions 63, a drain hole 71 having a substantially semicircular shape in elevational view is formed inside the upper guide rib portion 69*a* and the right and left guide rib portions 69*b* and outside the proximal end portion of the ink introducing pipe portion 63 in the radial direction about the ink introducing pipe portion 63. A stopper surface 72 is formed between outside the ink introducing pipe portion 63 and inside the upper guide rib portion 69*a* and right and left guide rib portions 69*b*, and which is to be held in contact only with a part of a distal end surface of a guide tube 65*a* of an ink supply portion (described below), thereby determining an amount of insertion of the ink cartridge 60 into the case 74. The drain hole 71 is formed in the stopper surface 72, as shown in FIG. 11.

As shown in FIGS. 7A, 7B, 11 and 12, for each of the four ink introducing pipe portions 63, an auxiliary drain hole 73 is formed in the lower vertical plate portion 62*b* inside the right and left guide rib portions 69*b* in the radial direction about the ink introducing pipe portion 68.

As shown in FIGS. 7A-7C, the arcuate upper guide rib portion 69*a* and right and left guide rib portions 69*b* fit on an outer peripheral portion of the guide tube 65*a* of the ink cartridge 60, thereby guiding guide tubes 65*a* during an insertion of the ink cartridge 60. When the ink cartridge 60 is accommodated (set) in the case 74, the ink introducing pipe portion 63 provided in a back surface (a rear surface) of the case 74 is connected to the ink supply valve 65 of the ink cartridge 60.

The ink cartridge 60 includes a cartridge main body 64 formed of synthetic resin and ink stored in the cartridge main body 64. In the present embodiment, the ink-cartridge accommodation device 15 accommodates four ink cartridges 60 which respectively contain four different colors of ink, namely, cyan, magenta, yellow, and black. In a structure of each of the four ink cartridges 60, as is obvious from FIGS. 1 and 5, the black ink cartridge 60 has a slightly larger thickness than the other ink cartridges 60. This is because black ink, in general, is used most frequently and consumed in a large amount. The other cartridges 60 have the same structure with each other.

In the present embodiment, the cartridge main body 64 has a thin rectangular parallelepiped shape as a whole. In the cartridge main body 64, an ink storage space is defined for storing ink therein. The cartridge main body 64 is constituted by a pair of right and left tray-like members which are joined by welding or other known fixing method.

Figure 6A:
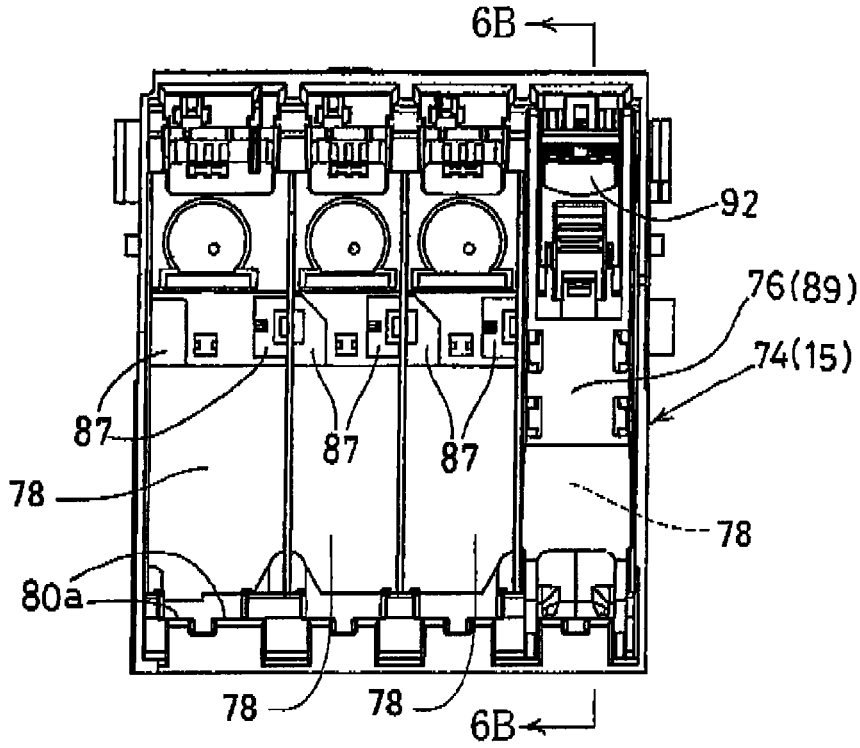
FIG. 6A is a front elevational view of the ink-cartridge accommodation device 15.
Figure 6B:
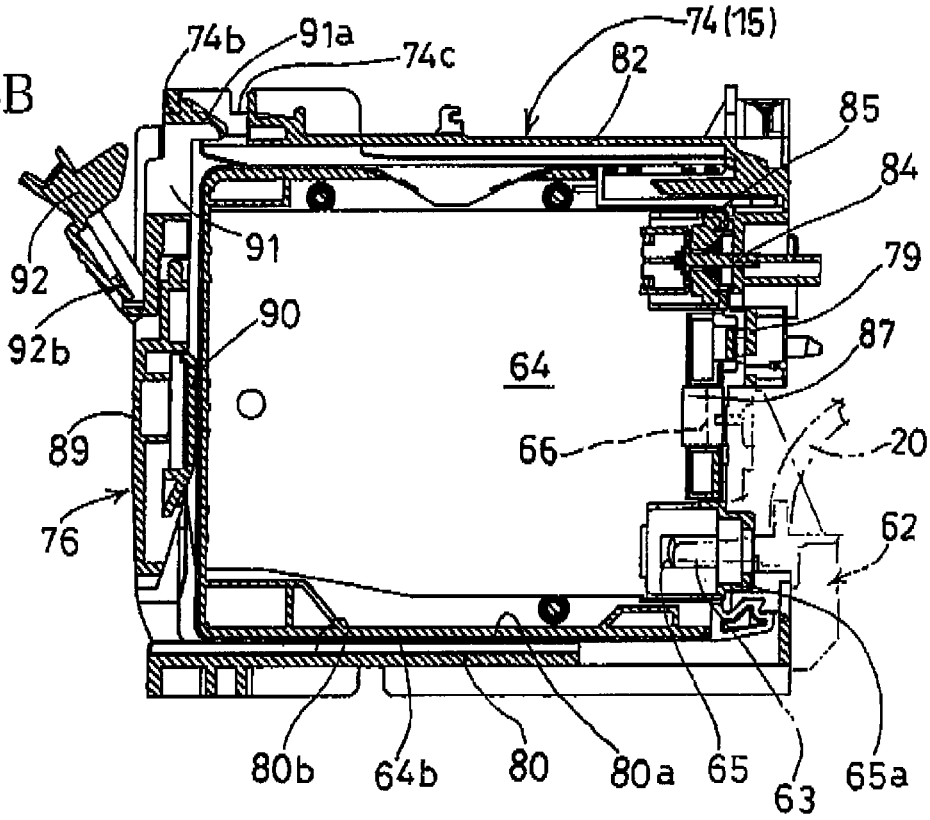
FIG. 6B is a cross-sectional view taken along line 6B-6B of FIG. 5.

An air induction valve 85 is provided on an upper portion of a back surface of the cartridge main body 64, for each of the four ink cartridges 60. In the present embodiment, a cheek valve (not shown) is disposed in an inside of the air induction valve 85. In each of the air induction valves 85, there is provided a push rod 84 which is projected from an interior to an exterior of the corresponding ink cartridge 60. When the ink cartridge 60 is accommodated in the case 74, the push rod 84 is pushed back into the interior of the ink cartridge 60 by contact thereof with a back wall of the case 74. This causes the check valve to be opened. On a lower portion of the back surface of the cartridge main body 64, there is provided the ink supply portion. With reference to FIG. 6B, the ink supply portion includes the guide tube 65*a* projected from the back surface of the cartridge main body 64 and the ink supply valve 65 disposed inside the guide tube 65*a*. The ink supply valve 65 formed of soft rubber or the like is operable to permit the ink introducing pipe portion 63 to be inserted into a central hole 65*b* of the ink supply valve 65 while the central hole 65*b* is normally closed.

Ink in the ink cartridge 60 is supplied to the recording head 4 via the ink introducing pipe portion 63 and the ink tube 20. On the back surface of the cartridge main body 64, there is provided a detectable portion 66 for detecting a level of ink in the ink cartridge 60. In the ink cartridge 60, there is provided a detectable member (an actuator, not shown) which moves according to a remaining amount of ink. On the back surface (the rear surface) of the case 74, an ink level sensor 87, such as a photo interrupter, is provided. When the ink cartridge 60 is accommodated (set) in the case 74, the ink level sensor 87 moves toward the detectable member and detects the presence or absence of the detectable member via the detectable portion 66. This enables an ink surface in the ink cartridge 60 to be monitored constantly.

Figure 8:
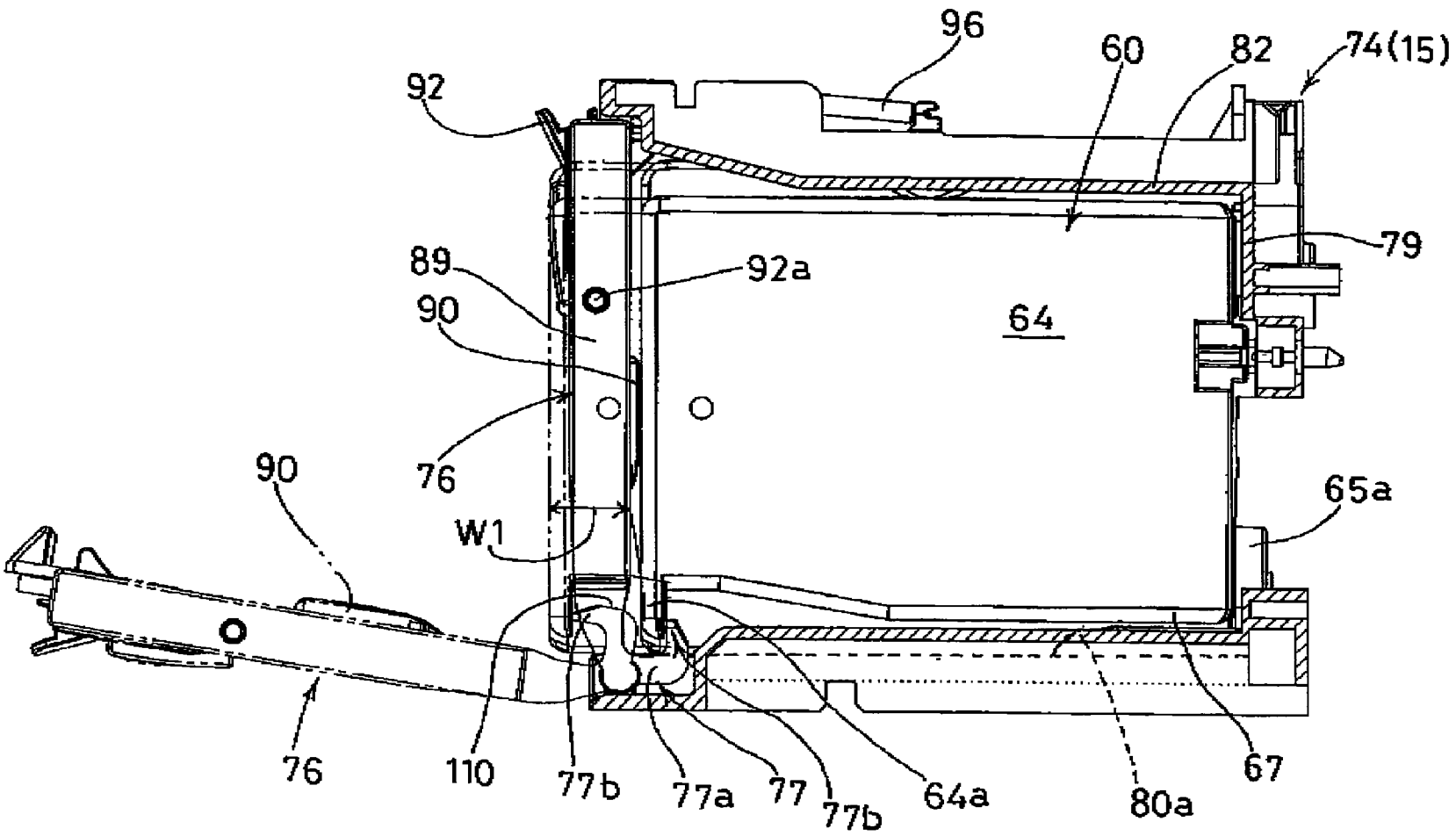
FIG. 8 is a side elevational view in cross section showing a state in which an ink cartridge is accommodated.
Figure 9:
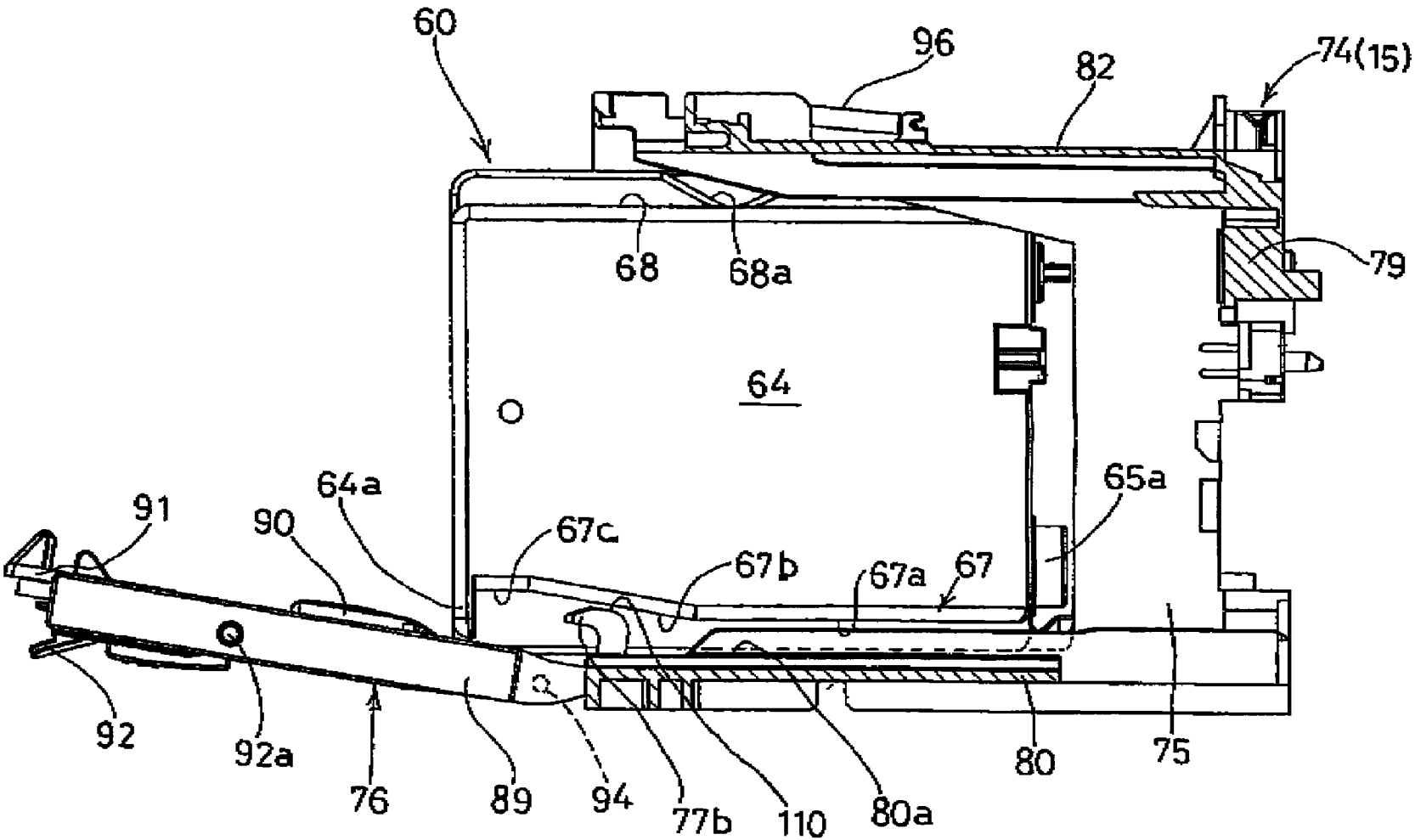
FIG. 9 is a side elevational view in cross section showing a state in which the ink cartridge is removed from the ink-cartridge accommodation device 15.

There are provided elongated guide grooves 67 in a lower portion of the cartridge main body 64 along a direction in which the ink cartridges 60 are inserted into the case 74. As shown in FIGS. 8 and 9, each of the guide grooves 67 is recessed in and along a corner portion of the ink cartridge 60 defined by a corresponding one of opposite side surfaces and a bottom surface of the cartridge main body 64. As shown in FIG. 8, the guide grooves 67 are formed so as to extend in a longitudinal direction of the cartridge main body 64.

In the present embodiment, the guide grooves 67 are symmetrically formed in respective right and left portions of the lower portion of the cartridge main body 64. Each of the guide grooves 67 includes a shallow portion 67*a*, an intermediate portion 67*b*, and a deep portion 67*c*. The shallow portion 67*a* opens to the back surface of the cartridge main body 64 and extends from the back surface of the cartridge main body 64 toward a front surface thereof. The intermediate portion 67*b* is continuous with the shallow portion 67*a* and gradually deepens toward the deep portion 67*c*, that is, a dimension of the intermediate portion 67*b* in the vertical direction in FIGS. 8 and 9 becomes gradually larger toward the deep portion 67*c*. The deep portion 67*c* is continuous with the intermediate portion 67*b*. In the front side of the cartridge main body 64, an end plate portion 64*a* is integrally formed with a front side wall thereof. The deep portion 67*c* is blocked by the end plate portion 64*a* so as not to be opened to the front surface of the cartridge main body 64.

In the present embodiment, with reference to FIGS. 5, 6B, 8, and 9, a bottom wall 64*b* of the cartridge main body 64 is placed on upper surfaces of a pair of flat guide rails 80*a* formed on a lower plate portion 80 in the case 74. The bottom wall 64*b* is guided linearly during insertion and withdrawal of the ink cartridge 60. A groove 80*b* located between the guide rails 80*a* has a concave shape in cross-section and serves as a drain groove for draining ink leaked from the ink cartridge 60.

On an upper side of the ink cartridge main body 64, there are formed grooves 68 each of which is recessed in and along a corner portion of the ink cartridge 60 defined by a corresponding one of the side surfaces and an upper surface of the cartridge main body 64. The groove 68 extends in the longitudinal direction of the cartridge main body 64 and is continuous with the front and the back surfaces of the cartridge main body 64. Furthermore, recesses 68*a* are formed in an intermediate portion of the upper side of the ink cartridge main body 64 in the longitudinal direction thereof. Each of the recesses 68*a* is substantially V-shaped and has a front and a rear inclined surface.

Figure 10A:
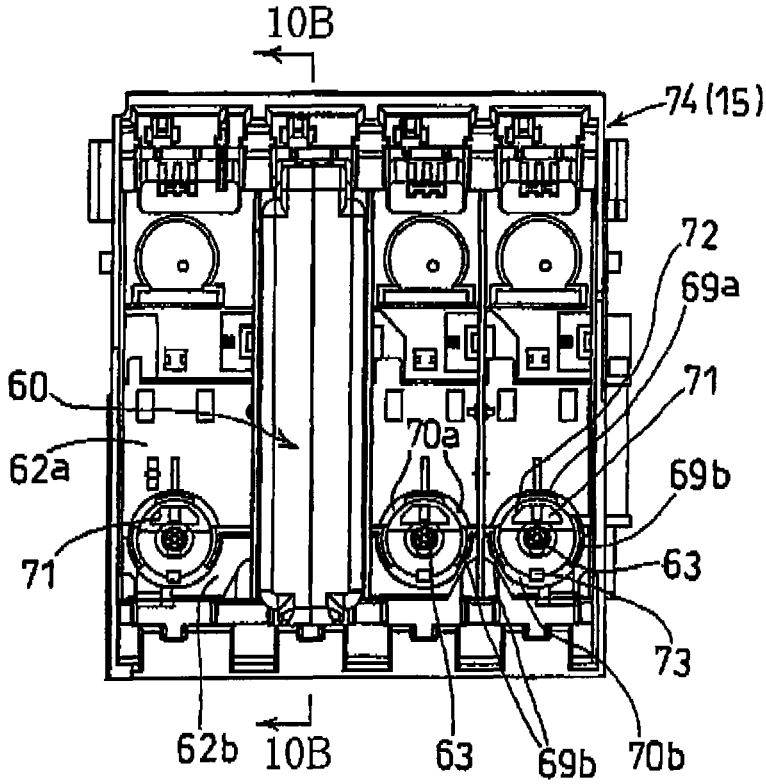
FIG. 10A is an elevational view of the ink-cartridge accommodation device 15 wherein the ink cartridge is accommodated only in the second accommodation chamber 78 as seen from the left, with its door removed.
Figure 10B:
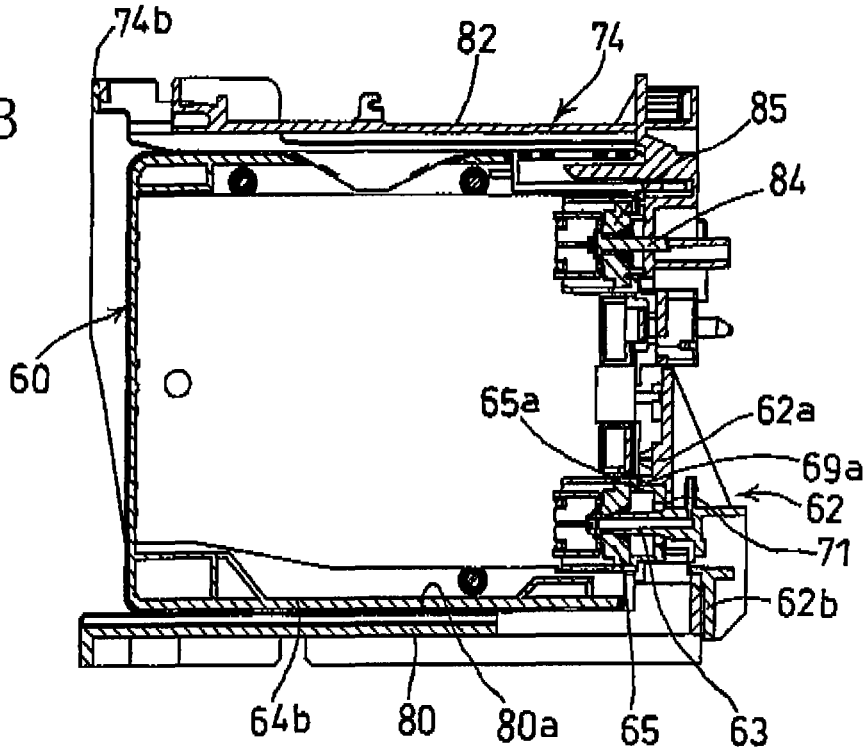
FIG. 10B is a cross-sectional view taken along line 10B-10B of FIG. 10A.

The case 74 formed of resin or the like has a substantially rectangular parallelepiped shape as a whole. The case 74 includes the lower plate portion 80, a pair of side plate portions 81, a top plate portion 82, and a rear plate portion 79. The pair of side plate portions 81 are erected on right and left portions of the lower plate portion 80, respectively. The top plate portion 82 is disposed so as to connect the side plate portions 81. The rear plate portion 79 is provided near the top plate portion 82 and connected to the side plate portions 81. The case 74 further includes the above-indicated front opening 74*a*. In the case 74, there are provided partition wall portions 75 by which the case 74 is partitioned into accommodation chambers 78 each as a cartridge accommodating portion Each of the accommodation chambers 78 is arranged to accommodate and hold a corresponding one of the ink cartridges 60. With reference to FIGS. 6A and 10A, the partition wall portions 75 are disposed according to the number of the ink cartridges 60 to be accommodated in the case 74.

In the present embodiment, the case 74 includes the four accommodation chambers 78 each of which is arranged to permit a corresponding one of the ink cartridges 60 to be inserted thereinto and withdrawn therefrom through the front opening 74*a*. An inner shape of each accommodation chamber 78 corresponds to an outer shape of the corresponding ink cartridge 60. This enables the ink cartridges 60 to be securely held in the case 74 without rattling. The partition wall portions 75 are not necessarily arranged such that the case 74 is completely partitioned into the accommodation chambers 78, but may be formed in a rib-like shape at least in a back portion of the interior of the case 74 (a portion near to the rear plate portion 79) for partitioning the case 74 into the accommodation chambers 78 that are adjacent to each other. It is preferable that the lower plate portion 80, the side plate portions 81, the top plate portion 82, the rear plate portion 79, and the partition wall portions 75 are formed integrally with each other.

With reference to FIG. 6B, on an upper surface of the lower plate portion 80, the guide rails 80*a*, each as a placing surface, are formed such that the ink cartridge 60 is placed and slidably moved along the longitudinal direction thereof. A height of the guide rails 80*a* is predetermined such that the needle-like ink introducing pipe portion 63 is inserted into the ink supply valve 65, such that the push rod 84 opens the air induction valve 85 (FIG. 6B), and such that the ink level sensor 87 is fitted to the detectable portion 66 in a state in which the ink cartridge 60 is inserted into the accommodation chamber 78. These configurations enable air to enter the interior of the ink cartridge 60 via the air induction valve 85, resulting in permitting ink in the ink cartridge 60 to be smoothly sent to the recording head 4.

Figure 5:
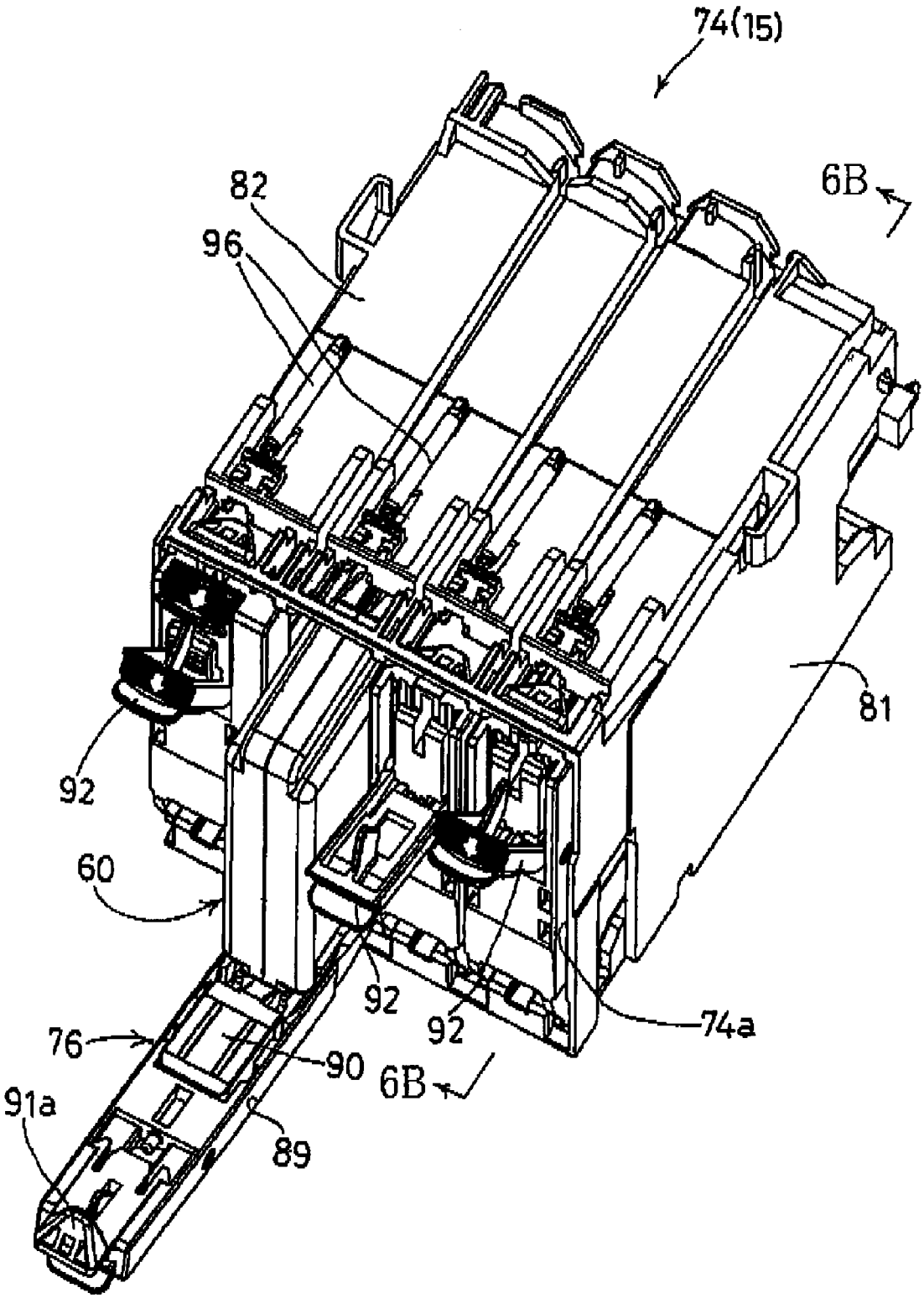
FIG. 5 is a perspective view of an ink-cartridge accommodation device 15.

As shown in FIGS. 5 and 11, for the front opening 74*a* in the case 74, there are provided the doors 76 which correspond to the accommodation chambers 78, respectively. In other words, each of the accommodation chambers 78 is provided in the case 74 so as to be continuous with the front opening 74*a*. Each of the ink cartridges 60 is inserted into and withdrawn from a corresponding one of the accommodation chambers 78 through the front opening 74*a*.

Each of the doors 76 formed of synthetic resin or the like is pivotably supported at a front lower end portion of the case 74 through a lateral shaft portion 94 which is formed at a lower end portion of the door 76. As shown in FIG. 5, each door 76 which is pivotably supported as described above is configured such that its posture is changed between a closed posture in which the front opening 74*a* is closed and an open posture in which the front opening 74*a* is opened. When the door 76 is in the closed posture, the ink cartridge 60 is securely held in the accommodation chamber 78. When the door 76 is in the open posture, the ink cartridge 60 is easily inserted into and withdrawn from the accommodation chamber 78.

As shown in FIGS. 5, 6B, 8, and 9, the door 76 includes a door body 89 on which a pressure member 90, a locking member 91, and a lock release lever 92 are provided. These are formed of resin.

On a lower end portion of each door body 89, a pair of drawer portions 77 are integrally formed with the door body 89. Each of the drawer portions 77 is substantially L-shaped (hook shaped) and has an extending portion 77*a* and a bending portion 77*b*. As shown in FIG. 8, the extending portion 77*a* extends backward from the lower end portion of the door body 89 in a state in which the door 76 is closed. The bending portion 77*b* is continuous with a rear end of the extending portion 77*a* and extends upward and substantially perpendicularly to a direction in which the extending portion 77*a* extends. When the door 76 is in the closed posture, a distal end of the bending portion 77*b* is positioned above the guide rails 80*a*. The drawer portions 77 are pivoted with the door body 89, whereby the end plate portion 64*a* formed at a lower end of the front side wall of the ink cartridge 60 is pushed by the distal end of the bending portion 77*b* in a direction in which the ink cartridge 60 is withdrawn. As a result, the ink cartridge 60 is withdrawn from the accommodation chamber 78 by a slight distance W1, as indicated by two-dot chain line in FIG. 8.

As shown in FIG. 8, when the posture of the door 76 is changed to the open posture from the closed posture, the bending portions 77*b* of the drawer portions 77 pivot about the lateral shaft (pivot shaft) 94 in a counterclockwise direction. By this pivoting of the bending portions 77*b*, outer surfaces 110 of the bending portions 77*b* which have been kept in a substantially vertically extended state are placed into a substantially horizontally extended state, as shown in FIG. 8. The extending portions 77*a* of the drawer portions 77 have a predetermined length such that, when the bending portions 77*b* are pivoted, the outer surfaces 110 are positioned slightly above the guide rails 80*a* of the case 74 and extend in a forward and backward direction of the case 74. When the door 76 is in the open posture, the outer surfaces 110 serve as guide surfaces by which the ink cartridge 60 is guided onto the guide rails 80*a* provided in the accommodation chamber 78. That is, the drawer portions 77 serve not only as a withdrawing means for withdrawing the ink cartridge 60 from the accommodation chamber 78, but also as a guide means for guiding the ink cartridge 60 during the insertion of the ink cartridge 60 into the accommodation chamber 78, as shown in FIGS. 8 and 9.

As shown in FIGS. 5, 6B, 8, and 9, the pressure member 90 is attached to an inner surface of the door body 89 so as to be movable in the forward and backward direction of the case 74 in a state in which the door 76 is opened. The pressure member 90 has a flat plate-like shape, for instance, and is elastically biased by a compression coil spring (not shown) which is disposed between the pressure member 90 and the door body 89, such that the pressure member 90 is kept protruded from the door body 89. Accordingly, when the door 76 is in the closed posture, the pressure member 90 is held in contact with the front surface of the ink cartridge 60, whereby the ink cartridge 60 is positioned to and held in the case 74.

The locking member 91 is attached to an upper end portion of the door body 89 and arranged to be advanced and retracted by a predetermined distance in the vertical direction. The locking member 91 has a hook portion 91*a* projecting upward in the case 74 in a state in which the door 76 is closed. The locking member 91 is elastically biased by a biasing spring (not shown) such that the hook portion 91*a* is kept projected upward from the door body 89. An upper surface of the hook portion 91*a* is an inclining surface which inclines downward. Accordingly, as shown in FIGS. 5 and 6B, when the posture of the door 76 is changed to the closed posture from the open posture, the upper surface of the hook portion 91*a* is brought into contact with an upper edge portion 74*b* of the case 74 which partially defines the front opening 74*a*. When the door 76 is further pivoted, the locking member 91 is retracted into the door body 89 with relatively pushed by the upper edge portion 74*b*. When the hook portion 91*a* comes into engagement with an engagement hole 74*c* formed in a back of the upper edge portion 74*b*, the door 76 is held in the closed posture. In the elevational view of FIG. 6 showing the ink-cartridge accommodation device 15, one of the doors 76 for the rightmost accommodation chamber 78 is shown, while the others are not shown.

As shown in FIGS. 5 and 6B, each lock release lever 92 has a shape of a rectangular plate and is attached to an upper portion of an outer surface of a corresponding one of the door bodies 89. The lock release lever 92 is configured to be pivotable relative to the door body 89 about a support pin 92*a* which is provided at a lower end portion of the lock release lever 92. In the present embodiment, the lock release lever 92 pivots among a standing posture, an intermediate posture, and a laying posture. In the standing posture, the lock release lever 92 stands substantially parallel to the outer surface of the door body 89 as shown in FIG. 8. In the intermediate posture, the lock release lever 92 inclines forward substantially at 40 degrees with respect to a vertical surface as shown in FIG. 6B. In the laying posture, the lock release lever 92 lies substantially horizontally as shown in FIG. 5.

As shown in FIG. 6B, a cam 92*b* is provided at a lower end of the lock release lever 92. When the posture of the lock release lever 92 is changed to the laying posture from the intermediate posture, the cam 92*b* pushes down the locking member 91 and releases a lock of the door 76, that is, the hook portion 91*a* is disengaged from the engagement hole 74*c*.

On the top plate portion 82 of the case 74, there are provided swing arms (not shown) each of which has a substantially L-shape in side view and protrudes from an upper portion of a corresponding one of the accommodation chambers 78 through a through-hole. The swing arm is normally biased by a tensile biasing spring 96 so as to pivot in a direction in which the swing arm pushes the ink cartridge 60. When a lower end of the swing arm is held in contact with an upper surface of the ink cartridge 60 which is inserted into the accommodation chamber 78, the swing arm receives a reaction force from the ink cartridge 60 against an elastic force of the tensile biasing spring 96. Therefore, when the door 76 is widely opened as described above and the ink cartridge 60 is withdrawn to a position indicated by the two-dot chain line in FIG. 8, the lower end of the swing arm is fitted in the recess 68*a* which is substantially V-shaped and provided on the upper surface of the ink cartridge 60. This causes the swing arm to pivot, whereby the ink cartridge 60 is forced to be pushed out of the accommodation chamber 78, as shown in FIG. 9.

The ink cartridge 60 in which ink is used up is replaced in the following manner. In removing the ink cartridge 60 from the case 74, a corresponding one of the door 76 is opened. When the posture of the door 76 is changed to the open posture from the closed posture, the pair of drawer portions 77 hook the end plate portions 64*a* which are formed at a lower end of the ink cartridge 60 and withdraw the ink cartridge 60 toward the front opening 74*a*. This facilitates user's withdrawal of the ink cartridge 60 from the case 74 through the front opening 74*a*. In accommodating the ink cartridge 60 into the accommodation chamber 78, the ink cartridge 60 is inserted into the accommodation chamber 78 through the front opening 74*a*, with the door 76 opened. At this time, a front portion of a lower surface of the ink cartridge 60 which is to be inserted into the accommodation chamber 78 is supported in advance by the drawer portions 77. Accordingly, the ink cartridge 60 is inserted into the accommodation chamber 78 while guided by the drawer portions 77. A rear portion (a back portion) of the lower surface of the ink cartridge 60 slidably moves on the flat guide rails 80*a*. Consequently, the ink cartridge 60 can be easily, reliably, and smoothly inserted into and withdrawn from the accommodation chamber 78.

In mounting a new ink cartridge on the case 74, a user recloses the door 76 when the new ink cartridge 60 is accommodated in the case 74. When the posture of the door 76 is changed to the closed posture, the pressure member 90 is brought into contact with the front surface of the ink cartridge 60. When the door 76 is completely in the closed posture, the pressure member 90 elastically biases the ink cartridge 60 toward an inner rear portion of the accommodation chamber 78. At the same time, the hook portion 91*a* of the locking member 91 comes into engagement with the engagement hole 74*c* formed in the case 74, so that the door 76 is held in the closed posture.

In this state, the guide tube 65*a* which constitutes the ink supply portion of the ink cartridge 60 is advanced, while guided by inner peripheral surfaces of the upper guide rib portion 69*a* and the right and left guide rib portions 69*b* of the connector 62. The stopper surface 72 is brought into contact only with a part of a distal end surface of the guide tube 65*a* (a part of an upper half of the distal end surface of the guide tube 65*a*, which part is near to an outer periphery of the same 65*a*), thereby determining an amount of insertion of the ink cartridge 60, as shown in FIG. 11.

When the ink cartridge 60 is accommodated (set) in the case 74 in this manner, the needle-like ink introducing pipe portion 63 which is provided on the rear portion of the case 74 is connected to the ink supply valve 65 provided near to a lower part of the back surface of the cartridge main body 64. And then, ink is supplied to the recording head 4 via the ink introducing pipe portion 63 and the ink tube 20. On the other hand, the air induction valve 85 which is provided on the upper portion of the back surface of the cartridge main body 64 is pressed by the case 74, and the check valve provided in the inside of the air induction valve 85 is opened by the push rod 84 which is pushed back to the interior of the ink cartridge 60. And then, an atmospheric pressure acts on ink in the cartridge main body 64, thereby realizing a smooth ink supply.

In replacement of the used ink cartridge 60 as described above, waste ink adheres to an outer peripheral surface of the ink introducing pipe portion 63 upon removal of the used ink cartridge 60 from the case 74. If the replacement, namely, the insertion and removal, of the ink cartridge are repeated, the waste ink flows toward the proximal end of the ink introducing pipe portion 63 from the outer periphery surface thereof and tends to accumulate around the proximal end thereof. However, a portion toward which the waste ink flows is located between the outer periphery of the ink introducing pipe portion 63 and the inner periphery of the guide rib portions 69*a*, 69*b*, that is, the portion is constituted by the drain hole 71 which is formed in a part of the stopper surface 72. Accordingly, the waste ink flows down to a lower portion of a back surface of the connector 62 through the drain hole 71. This prevents the waste ink from transferring to and staining the guide tube 65*a* of the ink cartridge 60. The waste ink flowed down is absorbed and held in a porous ink absorber (not shown) which is disposed on the back surface or a lower end of the connector 62. This also prevents the waste ink from staining the bottom portion of the image-recording apparatus 1 or a desk on which the image-recording apparatus 1 is disposed.

The stopper surface 72 is substantially held in contact only with the corresponding upper half of the distal end surface of the guide tube 65*a*, while a lower half of the distal end surface of the guide tube 65*a* is not held in contact with the lower vertical plate portion 62*b* which is positioned more backward than the stopper surface 72. This prevents waste ink from transferring to and staining the whole distal end surface of the guide tube 65*a*. Furthermore, the guide rib portions 69*a*, 69*b* separated by the upper gaps 70*a* and having the arcuate shape described above are held in contact with the outer peripheral surface of the guide tube 65*a*, thereby preventing the waste ink from transferring to and staining the whole outer peripheral surface of the guide tube 65*a*. In particular, the lower gap 70*b* is formed between and below lower ends of the right and left guide rib portions 69*b* and is not held in contact with a lower potion of the outer peripheral surface of the guide tube

65*a*, so that the waste ink which has flown from the ink introducing pipe portion 63 is prevented from staining the outer peripheral surface of the guide tube 65*a*.

In addition, the auxiliary drain holes 73 are formed in the lower vertical plate portion 62*b*. The waste ink flows down to a lower portion of the connector 62 through the auxiliary drain holes 73 and is absorbed in the ink absorber, thereby preventing the waste ink from staining the bottom portion of the image-recording apparatus 1 or the desk on which the image-recording apparatus 1 is disposed.

In the present embodiment mentioned above, the ink-cartridge accommodation device 15 is configured such that the stopper surface 72 which is located inside the guide rib portions 69*a*, 69*b* in the radial direction about the ink introducing pipe portion 63 is held in contact with the guide tube 65*a*, thereby determining the amount of insertion of each ink cartridge 60. However, the ink-cartridge accommodation device 15 may also be configured such that at least one of distal end surfaces of the guide rib portions 69*a*, 69*b* is held in contact with a proximal and the outer peripheral portion of the guide tube 65*a* or with a stopper surface which is provided in a back surface of the ink cartridge 60 (shown in FIG. 12). In this configuration, the distal end surface of the guide tube 65*a* is not held in contact with a part of the upper vertical plate portion 62*a* which is located inside the guide rib portions 69*a*, 69*b* in the radial direction about the ink introducing pipe portion 63. This further prevents the waste ink from staining the guide tube 65*a*.

The present invention may be applied to an ink-cartridge accommodation device in which an opening is formed in an upper surface of the case of the ink-cartridge accommodation device and in which the ink introducing pipe portion is projected from the bottom portion of the case and opened upward. In the thus configured ink-cartridge accommodation device, a protective cap portion may be inserted from above into the ink introducing pipe portion. It should be understood that the present invention may be applicable not only to an off-carriage type ink cartridge of the present embodiment but also to an on-carriage type ink cartridge.

What is claimed is:

1. An ink-cartridge accommodation device comprising:

a case which has a front opening and which accommodates an ink cartridge storing ink so as to permit the ink cartridge to be inserted into and withdrawn from the case through the front opening; and a connector which is disposed so as to be opposed to the front opening and which is to be connected to an ink supply portion of the ink cartridge, the connector comprising (a) an ink introducing pipe portion projecting from an inside of the case toward the front opening, (b) a guide rib portion provided around the ink introducing pipe portion so as to project from an inside of the case toward the front opening for guiding the ink supply portion, and (c) a wall which is formed at a position located on a rear side of respective distal ends of the ink introducing pipe portion and the guide rib portion and which faces toward the front opening, the wall having a drain hole provided in the wall at a position between the ink introducing pipe portion and the guide rib portion to drain the ink.

2. The ink-cartridge accommodation device according to claim 1, wherein the ink introducing pipe portion is configured to be inserted into the ink supply portion and to introduce the ink in the ink cartridge, and wherein the drain hole is provided for draining the ink adhering to and remaining on an outer periphery of the ink introducing pipe portion.

3. The ink-cartridge accommodation device according to claim 1, wherein the drain hole extends through the wall.

4. The ink-cartridge accommodation device according to claim 3, wherein the drain hole is provided such that the ink is drained via the drain hole to an exterior of the case.

5. The ink-cartridge accommodation device according to claim 1, wherein the wall has a stopper surface which is provided between the ink introducing pipe portion and the guide rib portion and which is to be held in contact only with a part of a distal end surface of the ink supply portion, thereby determining an amount of insertion of the ink cartridge into the case.

6. The ink-cartridge accommodation device according to claim 5, wherein the drain hole is open in the stopper surface.

7. The ink-cartridge accommodation device according to claim 1, which is configured such that the ink cartridge is to be inserted into the case in a substantially horizontal direction, and wherein the ink introducing pipe portion projects in the substantially horizontal direction.

8. The ink-cartridge accommodation device according to claim 1, wherein the guide rib portion is configured to be held in contact only with a part of an outer periphery of the ink supply portion.

9. The ink-cartridge accommodation device according to claim 8, which accommodates the ink cartridge having the ink supply portion whose outer shape is generally cylindrical, and wherein the guide rib portion has an arcuate shape in cross-section taken in a plane perpendicular to a direction in which the guide rib portion projects.

10. The ink-cartridge accommodation device according to claim 8, wherein the guide rib portion is configured not to be held in contact with a lower part of the outer periphery of the ink supply portion.

11. The ink-cartridge accommodation device according to claim 10, wherein the guide rib portion is configured to be held in contact with at least an upper part of the outer periphery of the ink supply portion.

12. The ink-cartridge accommodation device according to claim 11, wherein the connector has a stopper surface which is provided between the ink introducing pipe portion and the guide rib portion and which is to be held in contact only with at least a part of an upper half of a distal end surface of the ink supply portion, thereby determining an amount of insertion of the ink cartridge into the case, and wherein the drain hole is open in the stopper surface.

13. The ink-cartridge accommodation device according to claim 1, wherein a part of an inner peripheral surface of the drain hole is constituted by at least a part of an outer peripheral surface of the ink introducing pipe portion, whereby a proximal end of the ink introducing pipe portion is more distant from the front opening of the case than a proximal end of the guide rib portion.

14. The ink-cartridge accommodation device according to claim 13, wherein the drain hole extends through the wall, and wherein the proximal end of the ink introducing pipe portion reaches one of opposite surfaces of the connector which is not opposed to the front opening.

15. The ink-cartridge accommodation device according to claim 1, wherein the connector has a stopper surface which is provided on the distal end of the guide rib portion and which is to be held in contact with a portion of the ink cartridge, thereby determining an amount of insertion of the ink cartridge into the case.

16. The ink-cartridge accommodation device according to claim 1, further comprising a door capable of opening and closing the front opening.

17. The ink-cartridge accommodation device according to claim 16, wherein the door is configured to maintain a posture of the ink cartridge which is accommodated in the case.

* * * * *